US005078504A

United States Patent [19]

Landa et al.

[11] Patent Number: 5,078,504

[45] Date of Patent: Jan. 7, 1992

[54] DISPERSION APPARATUS

[75] Inventors: Benzion Landa, Edmonton, Canada; Avner Schneider, Nes Ziona, Israel

[73] Assignee: Spectrum Sciences B.V., Rotterdam, Netherlands

[21] Appl. No.: 306,066

[22] Filed: Feb. 6, 1989

[51] Int. Cl.[5] ..... B01R 11/00

[52] U.S. Cl. ..... 366/118; 366/276; 366/243; 366/177

[58] Field of Search ..... 366/40, 64, 36, 114, 366/116, 127, 267, 279, 275, 276, 17, 165, 118, 166, 342, 107, 108, 168, 169, 170, 171, 172, 173, 174, 175; 210/515, 519, 512.3, 219, 220; 239/242; 162/243, 244, 246, 248; 68/355, 207; 134/184

[56] References Cited

U.S. PATENT DOCUMENTS

| | | | |
|---|---|---|---|
| 165,192 | 7/1875 | Warren | 366/275 X |
| 555,892 | 4/1896 | Root . | |
| 2,124,983 | 7/1938 | Martin | 366/275 |
| 2,499,203 | 2/1950 | Warren | 366/275 |
| 2,598,500 | 5/1952 | Burke . | |
| 2,637,625 | 5/1953 | Garbo | 366/108 X |
| 2,962,201 | 11/1960 | Brillis et al. | 366/275 X |
| 3,132,845 | 5/1964 | Norty . | |
| 3,251,576 | 5/1966 | Horsley | 366/128 X |
| 3,304,449 | 2/1967 | Poncman et al. | 366/118 |
| 3,313,240 | 4/1967 | Bentov | 366/275 X |
| 3,491,782 | 1/1970 | Oele et al. | 137/13 |
| 3,730,202 | 5/1973 | Wolf | 137/13 |
| 3,867,195 | 2/1975 | Pfeuffer | 366/108 |
| 3,925,243 | 12/1975 | Brogli et al. . | |
| 4,085,170 | 4/1978 | Simpson et al. | 366/127 X |
| 4,347,002 | 8/1982 | Born . | |
| 4,793,714 | 12/1988 | Gruber | 366/275 |
| 4,794,651 | 12/1988 | Landa et al. . | |
| 4,860,050 | 8/1989 | Kurotori et al. . | |
| 4,885,098 | 12/1989 | Bodine | 366/124 X |

FOREIGN PATENT DOCUMENTS

| | | | |
|---|---|---|---|
| 208161 | 9/1955 | Australia | 366/127 |
| 3725002 | 2/1988 | Fed. Rep. of Germany . | |
| 1279661 | 12/1986 | U.S.S.R. | 366/108 |
| 1327945 | 8/1987 | U.S.S.R. | 366/108 |

*Primary Examiner*—Frankie L. Stinson
*Attorney, Agent, or Firm*—Sandler, Greenblum & Bernstein

[57] ABSTRACT

Dispersion apparatus for dispersing a first material in a second material comprising an enclosure having disposed therein an apertured divider defining first and second sub-enclosures within said enclosure on opposite sides of said divider, a first inlet for said first material communicating with said first sub-enclosure, a port for said second material communicating with said second sub-enclosure, and means for enhancing the passage of materials through said divider.

17 Claims, 3 Drawing Sheets

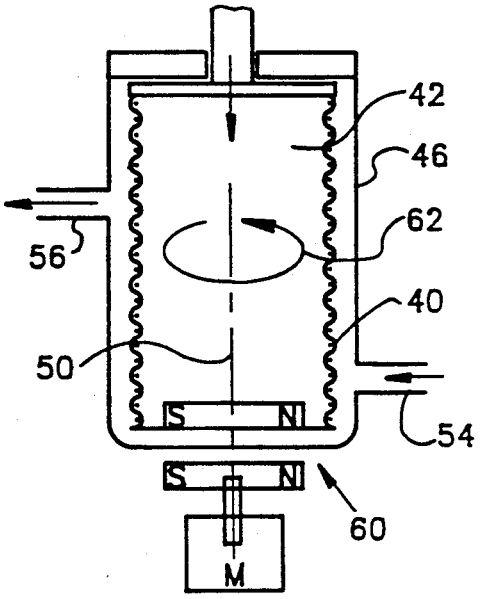
FIG.4
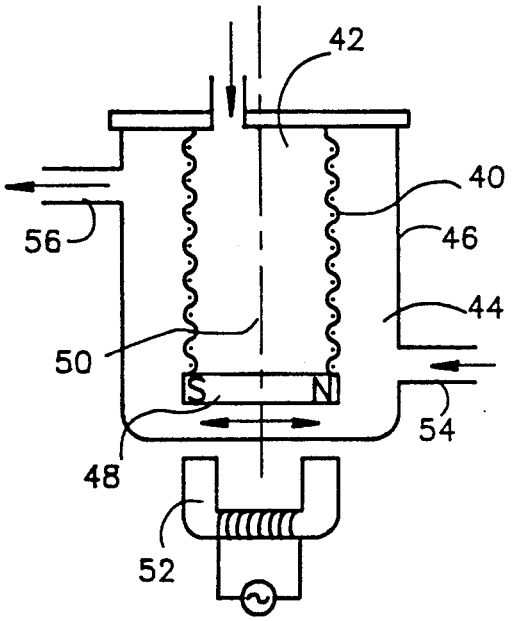
FIG.3
FIG.2
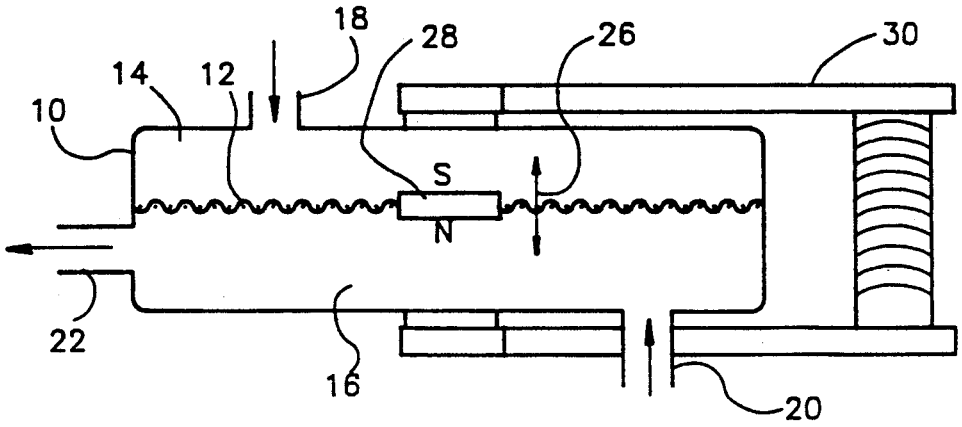

DISPERSION APPARATUS

FIELD OF THE INVENTION

The present invention relates to dispersion apparatus generally and has particular applicability to liquid toner electrophotography.

BACKGROUND OF THE INVENTION

Various techniques have been proposed for dispersing a relatively viscous material in a relatively less viscous material. U.S. Pat. No. 2,598,500 to Burke describes agitating apparatus including a matrix of closely spaced vibratable wires and contains a statement to the effect that the device can be used as a mixer wherein one or more fluids may be introduced to the wires through a common inlet.

U.S. Pat. No. 3,132,845 to Norty describes a vibratory mixer having particular utility in mixing materials of high viscosity wherein such materials may be supplied via two inlets to a rotating blade which provides preliminary mixing and thence to a vibratory actuator wherein they are forced through perforations therein.

U.S. Pat. No. 557,892 to Root describes a machine for mixing or blending flours including a premixing stage followed by an agitating stage.

U.S. Pat. No. 3,925,243 to Brogli et al describes apparatus for manufacturing emulsions wherein a liquid to be emulsified is injected directly into the periphery of a stirrer that is rotated in a liquid in which the emulsion is to be made.

U.S. Pat. No. 4,347,002 to Born describes a method and apparatus for the preparation of drilling mud employing reciprocating perforated plates which move back and forth, towards and away from each other, thus forcing the constituents of the drilling mud through the perforations and producing mixing thereof.

German Laid Open Patent Application 3725002 A1, published on Feb. 4, 1988, less than one year prior to the filing of this application, describes inter alia and illustrates in FIG. 16 a toner disperser including an apertured drum in which is disposed a driven spiral disperser. A concentrated toner is supplied to the interior of the apertured drum and passes out through the apertures therein to a dispersing liquid.

SUMMARY OF THE INVENTION

The present invention seeks to provide apparatus for dispersing a relatively more viscous material in a relatively less viscous material which departs from the prior art in both its structure and its principle of operation.

The present invention seeks to provide improved dispersion apparatus wherein at least two ingredients to be mixed are introduced into engagement with an apertured divider, such as a screen, from opposite sides thereof, so as to prevent mixing of the ingredients before passage of at least one of the ingredients through the screen.

There is thus provided in accordance with a preferred embodiment of the present invention dispersion apparatus for dispersing a first material in a second material including an enclosure having disposed therein an apertured divider defining first and second sub-enclosures within the enclosure on opposite sides of the divider, an inlet for the first material communicating with the first sub-enclosure, a port for the second material communicating with the second sub-enclosure and apparatus for enhancing the passage of the first material through the divider.

There is also provided in accordance with a preferred embodiment of the present invention dispersion apparatus for dispersing a first relatively more viscous material in a second relatively less viscous material including an enclosure having disposed therein a moving apertured divider defining first and second sub-enclosures within the enclosure on opposite sides of the divider, an inlet for the first relatively more viscous material communicating with the first sub-enclosure, a port for the second relatively less viscous material communicating with the second sub-enclosure and apparatus for enhancing the passage of the first material through the divider.

Additionally in accordance with a preferred embodiment of the present invention there is provided for use in association with electrophotographic apparatus employing liquid toner, toner dispersion apparatus comprising an enclosure having disposed therein a moving apertured divider defining first and second sub-enclosures within the enclosure on opposite sides of the divider, a toner concentrate inlet communicating with the first sub-enclosure and a working dispersion communication port communicating with the second sub-enclosure.

Further in accordance with a preferred embodiment of the present invention, the apertured divider is substantially horizontally disposed within the enclosure and the first sub-enclosure is located above the second sub-enclosure.

In accordance with an alternative preferred embodiment of the present invention, the apertured divider is substantially vertically disposed within the enclosure.

Additionally in accordance with a preferred embodiment of the present invention, the port comprises a second inlet and an outlet.

Further in accordance with a preferred embodiment of the present invention, the passage of materials through the divider is enhanced by providing motion of the particles of at least the first relatively more viscous material.

Further in accordance with a preferred embodiment of the present invention, the means for enhancing comprises a vibration generator.

Still further in accordance with a preferred embodiment of the present invention, the vibration generator comprises an electromagnetic driver or an acoustic driver.

Additionally in accordance with a preferred embodiment of the present invention, the electromagnetic driver is disposed externally of the enclosure and the vibration generator also comprises a magnet associated with the apertured divider and driven by the electromagnetic driver.

Additionally in accordance with a preferred embodiment of the present invention, the apertured divider is substantially cylindrical.

Still further in accordance with a preferred embodiment of the present invention, the first sub-enclosure is disposed inwardly of the second sub-enclosure.

Further in accordance with a preferred embodiment of the present invention, the passage of materials through the divider is enhanced by providing motion of the apertured divider.

Still further in accordance with a preferred embodiment of the present invention, at least a component of the motion of the apertured divider is perpendicular to the axis of the apertured divider.

Still further in accordance with a preferred embodiment of the present invention, the apertured divider moves in a plane substantially perpendicular to the axis of the cylindrical divider.

Additionally in accordance with a preferred embodiment of the present invention, the means for enhancing comprises a motion generator for providing the motion of the apertured divider and the motion generator comprises a magnet associated with the cylindrical divider for causing the cylindrical divider to move in a plane substantially perpendicular to the axis of the cylindrical divider, and an electromagnetic driver disposed externally of the enclosure for driving the magnet.

According to an alternative preferred embodiment of the present invention, the means for enhancing comprise a magnet associated with the divider for producing eccentric rotation of the divider, and an electromagnetic driver disposed externally of the enclosure for driving the magnet.

According to a further preferred embodiment of the present invention, the means for enhancing comprises a reciprocating liquid jet for directing the particles of the first relatively more viscous material toward the divider.

There is also provided in accordance with a preferred embodiment of the present invention a method of dispersing a first relatively more viscous material in a second relatively less viscous material comprising the steps of providing an enclosure having disposed therein an apertured divider defining first and second sub-enclosures within the enclosure on opposite sides of the divider, an inlet for the first relatively more viscous material communicating with the first sub-enclosure and a port for the second relatively less viscous material communicating with the second sub-enclosure, enhancing the passage of materials through the divider, and removing the dispersion of the first relatively more viscous material and the second relatively less viscous material from the second sub-enclosure.

BRIEF DESCRIPTION OF THE DRAWINGS

The present invention will be understood and appreciated more fully from the following detailed description, taken in conjunction with the drawings in which:

FIG. 2 is a generalized illustration of dispersion apparatus constructed and operative in accordance with another preferred embodiment of the invention;

FIG. 3 is a generalized illustration of dispersion apparatus constructed and operative in accordance with still another preferred embodiment of the invention;

FIG. 4 is a generalized illustration of dispersion apparatus constructed and operative in accordance with an alternative embodiment of the invention;

DETAILED DESCRIPTION OF PREFERRED EMBODIMENTS

The present invention will be described in detail hereinbelow with particular reference to the dispersion of a relatively viscous toner concentrate such as a 23 percent nonvolatile solids concentration of toner prepared in accordance with example 1 of U.S. Pat. No. 4,794,651 which is incorporated herein by reference, into a working dispersion, such as toner comprising ISOPAR toner particles, charge directors, etc. for example a 1.5 percent solids concentration of the toner prepared in accordance with example 1 of U.S. Pat. No. 4,794,651, which may have dispersed in it spurious particles, such as paper fibers. The dispersion apparatus, in a preferred embodiment is intended to form part of liquid toner electrophotographic apparatus, commonly termed, a liquid toner photocopier. Accordingly, simplicity of design and operation and reliability, as well as relatively low cost, high efficiency and small size are desiderata in the dispersion apparatus according to a preferred embodiment of the present invention.

It is to be appreciated, however, that the present invention is not limited to the dispersion of toner or any other specific material, nor is it limited to applications in electrophotography or any other specific application. The invention is also not limited to the use of materials having different viscosities or concentrations. The invention may be employed for dispersing one material in another material or alternatively mixtures of the same materials having different concentrations or having different viscosities.

Figure 1:
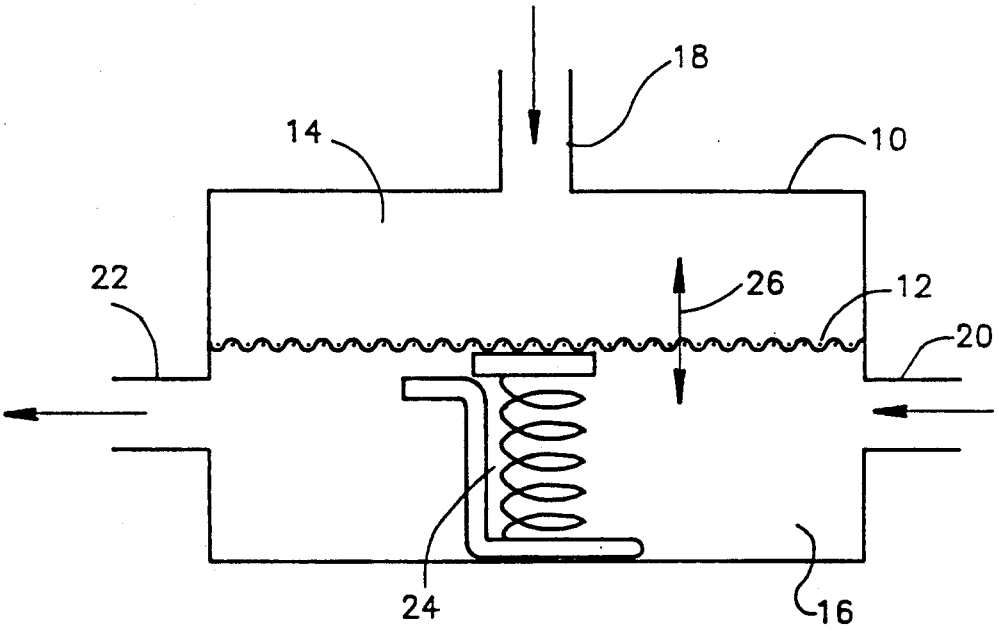
FIG. 1 is a generalized illustration of dispersion apparatus constructed and operative in accordance with a preferred embodiment of the invention.

Reference is now made to FIG. 1 which illustrates dispersion apparatus constructed and operative in accordance with a preferred embodiment of the present invention and comprising an enclosure 10 having a vibratable or otherwise movable apertured separation 12, such as an 86-mesh polyester screen disposed therein, thereby dividing the enclosure 10 into two sub-enclosures, preferably a top sub-enclosure 14 and a bottom sub-enclosure 16.

Top sub-enclosure 14 is preferably formed with an inlet 18 for receipt of a relatively viscous toner concentrate or any other suitable relatively viscous material. Bottom sub-enclosure 16 is preferably formed with an inlet 20 for receipt of a working dispersion, which is generally less viscous than the material received at inlet 18. As noted above, the working dispersion typically comprises ISOPAR which may have dispersed therein spurious particles such as paper fibers, which under certain circumstances could cause clogging of the divider 12.

In the illustrated embodiment of FIG. 1, an outlet 22 is provided for the completed dispersion of the toner concentrate in the working dispersion. According to an alternative embodiment of the invention, outlet 22 may be combined with inlet 20 in a single port.

Enhancement of dispersion and of the passage of materials through the divider 12 is provided in the illustrated embodiment by a motion generator, such as an electromagnetic driver 24, driven by a suitable power source (not shown) which produces movement such as vibration of the divider 12, generally in directions indicated by arrows 26.

The apparatus of FIG. 1 is preferably operative to provide generally controlled dispersion of the relatively viscous material, such as toner concentrate, in the relatively less viscous materials, such as an Isopar dispersion, for producing a desired mixture of the two, which passes through outlet 22.

Reference is now made to FIG. 2, which illustrates an alternative preferred embodiment of the present invention, also comprising an enclosure 10 and a divider 12 defining top and bottom sub-enclosures 14 and 16, a top inlet 18 and working dispersion inlet and outlet 20 and 22 respectively. Here, however, the dispersion inlet 20 is typically disposed at the bottom of the bottom sub-enclosure 16 rather than at its side as in the embodiment of FIG. 1. More importantly, in the embodiment of FIG. 2, a magnet 28 is associated with the divider 22 and is driven by an external electromagnetic driver 30 for motion, such as vibratory motion, in directions along arrows 26.

FIG. 3 illustrates a further alternative embodiment of the present invention wherein a cylindrical divider 40 separates an inner sub-enclosure 42 from an outer sub-enclosure 44 within a housing 46. A magnet 48 is associated with cylindrical divider 40 for producing motion thereof in a plane perpendicular to the axis 50 of the cylindrical divider 40, when driven by an external electromagnetic driver 52. Here a working dispersion inlet 54 and an outlet 56 communicate with the external sub-enclosure 44.

Reference is now made to FIG. 4, which illustrates an alternative embodiment of the present invention which is similar to that of FIG. 3 except that the driving arrangement including driver 52 of the embodiment of FIG. 3 is here replaced by an eccentric rotary drive arrangement including a rotary magnetic drive 60 which provides eccentric rotation of the entire divider 40 relative to the housing 46, as indicated generally by arrow 62.

Figure 5:
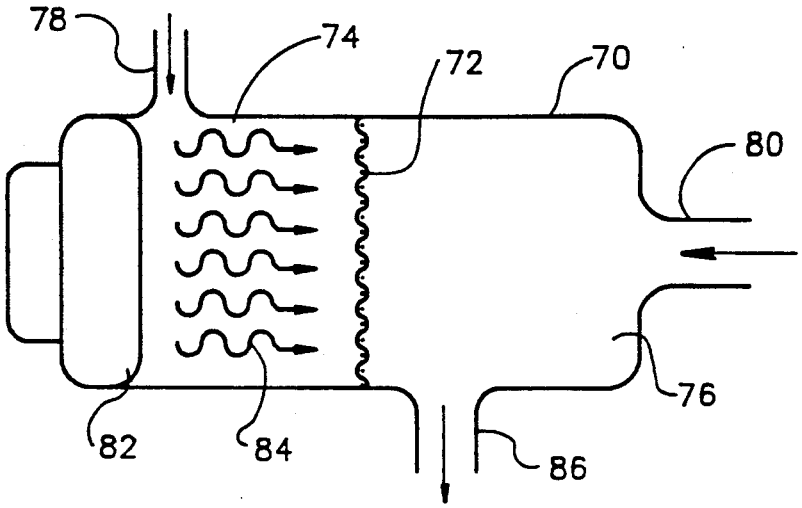
FIG. 5 is a generalized illustration of dispersion apparatus constructed and operative in accordance with another alternative embodiment of the invention.

FIG. 5 illustrates a further alternative embodiment of the invention including an enclosure 70, having disposed therewithin a generally vertically extending apertured divider 72, which divides the enclosure into first and second sub-enclosures 74 and 76. A relatively viscous material is supplied to sub-enclosure 74 via an inlet 78, while a relatively less viscous material is supplied to sub-enclosure 76 via an inlet 80. An acoustic driver 82, such as a microphone, produces vibration of the liquid in sub-enclosure 74 and enhances its passage through divider 72, as indicated by arrows 84. An outlet 86 permits the desired dispersion to be removed from sub-enclosure 76.

Figure 6:
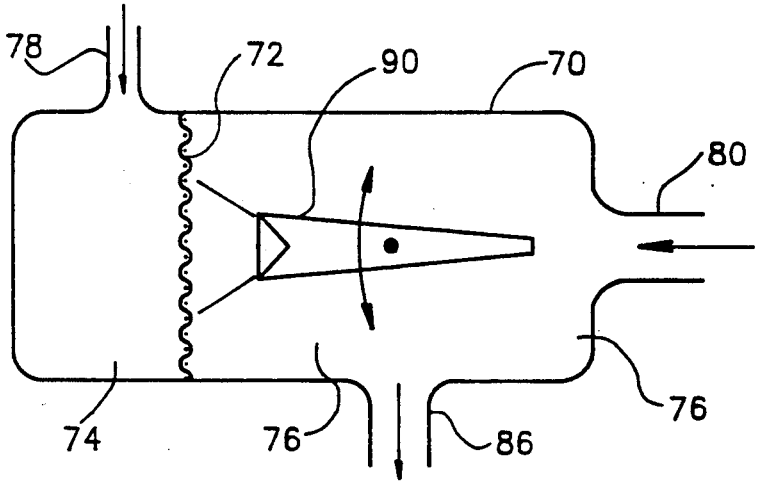
FIG. 6 is a generalized illustration of dispersion apparatus constructed and operative in accordance with a further alternative embodiment of the invention.

Reference is now made to FIG. 6, which illustrates a further alternative embodiment of the present invention, which is similar to that of FIG. 5 except that the use of an acoustic driver 82 is replaced by the use of a reciprocating liquid jet 90 for directing working dispersion against divider 72.

Figure 7:
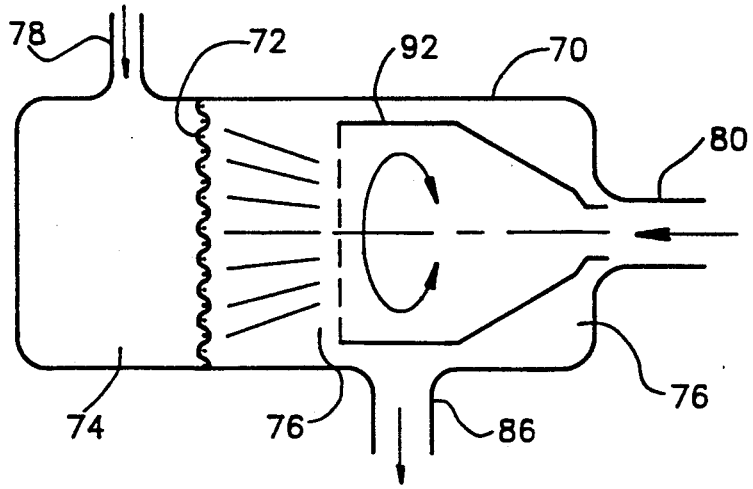
FIG. 7 is a generalized illustration of dispersion apparatus constructed and operative in accordance with yet another alternative embodiment of the invention.

In FIG. 7, another alternative embodiment of the invention is illustrated, wherein the reciprocating liquid jet 90 is replaced by a rotating liquid jet 92.

It will be appreciated by persons skilled in the art that the present invention is not limited by what has been particularly shown and described hereinabove. Rather the scope of the invention is defined only by the claims which follow:

We claim:

1. Dispersion apparatus for dispersing a relatively more viscous material into a relatively less viscous material comprising:

(a) an enclosure;

(b) a divider for separating said enclosure into first and second sub-enclosures;

(c) a first inlet port directly communicating with said first sub-enclosure for effecting entry thereinto of said relatively more viscous material;

(d) a second inlet port directly communicating with said second sub-enclosure for effecting entry thereinto of said relatively less viscous material;

(e) an outlet port communicating with said second sub-enclosure for effecting egress therefrom of the material in said second sub-enclosure;

(f) said divider including a mesh screen that interconnects the two sub-enclosures for interfacing the more viscous material in the first sub-enclosure with the less viscous material in the second sub-enclosure; and (g) means for moving at least said screen relative to said enclosure for effecting the passage through said screen of the relatively more viscous material and dispersing the material that passes through the screen into the material in said second sub-enclosure.

2. Dispersion apparatus according to claim 1 wherein said mesh screen is substantially horizontally disposed within said enclosure and wherein said first sub-enclosure is located above said second sub-enclosure.

3. Dispersion apparatus according to claim 1 wherein said mesh screen is substantially vertically disposed within said enclosure.

4. Dispersion apparatus according to claim 1 comprising an electromagnetic driver and a magnet associated with said mesh screen and driven by said electromagnetic driver.

5. Dispersion apparatus according to claim 1 wherein said divider is substantially cylindrical and wherein an axis of said cylindrical divider is defined and wherein said first sub-enclosure is disposed inwardly of said second sub-enclosure.

6. Dispersion apparatus according to claim 5 wherein said divider moves in a direction that is perpendicular to said axis of said divider.

7. Dispersion apparatus according to claim 6 wherein said mesh screen moves in a plane substantially perpendicular to said axis of said divider.

8. Dispersion apparatus according to claim 5 wherein said means for moving comprises a motion generator for providing said motion of said mesh screen and wherein said motion generator comprises: a magnet associated with said cylindrical divider for producing motion of said cylindrical divider; and an electromagnetic driver for driving said magnet.

9. Dispersion apparatus according to claim 5 wherein said means for moving comprises a motion generator for providing said motion of said mesh screen, said motion generator comprising a magnet associated with said cylindrical divider for producing eccentric motion of said cylindrical divider; and an electromagnetic driver for driving said magnet.

10. Dispersion apparatus according to claim 1 wherein said means for moving comprises: a magnet associated with said divider for producing rotation of said divider; and an electromagnetic driver for driving said magnet.

11. Dispersion apparatus according to claim 1 and wherein said mesh screen is substantially horizontally disposed within said enclosure and wherein said first sub-enclosure is located above said second sub-enclosure.

12. Dispersion apparatus according to claim 1 and wherein said mesh screen is substantially vertically disposed within said enclosure.

13. Dispersion apparatus according to claim 1 and wherein the passage of materials through said mesh screen is enhanced by providing motion of the relatively more viscous material.

14. Dispersion apparatus according to claim 1 wherein said means for moving is an electromagnetic driver disposed externally of said enclosure and a magnet associated with said divider and driven by said electromagnetic driver.

15. Dispersion apparatus according to claim 1 wherein said divider is substantially cylindrical and wherein an axis of said cylindrical apertured divider is defined.

16. Dispersion apparatus according to claim 15 and wherein said screen portion moves in a plane substantially perpendicular to said axis of said cylindrical divider.

17. Dispersion apparatus according to claim 16 and also comprising means for causing said apertured divider to move in a plane substantially perpendicular to said axis of said cylindrical divider, said means for causing comprising: a magnet associated with said cylindrical divider for producing motion of said cylindrical divider in a plane substantially perpendicular to the axis of said cylindrical divider; and an electromagnetic driver for driving said magnet.

* * * * *